US006229224B1

(12) United States Patent
Gagne

(10) Patent No.: US 6,229,224 B1
(45) Date of Patent: May 8, 2001

(54) PEDAL OPERATED POWER GENERATING SYSTEM

(76) Inventor: James P. Gagne, 73 Pearson Rd., Somerville, MA (US) 02144-1317

( * ) Notice: Subject to any disclaimer, the term of this patent is extended or adjusted under 35 U.S.C. 154(b) by 0 days.

(21) Appl. No.: 09/311,406

(22) Filed: May 13, 1999

(51) Int. Cl.[7] ..... H02P 9/04

(52) U.S. Cl. ..... 290/1 R; 290/1 A; 290/1 C; 290/49

(58) Field of Search ..... 290/1 R, 45, 7 JC, 290/4 J; 310/75 R

(56) References Cited

U.S. PATENT DOCUMENTS 3,210,634 * 10/1965 Stern ..... 290/1 R
3,831,942 * 8/1974 Del Mar ..... 272/73
4,613,129 * 9/1986 Schroeder et al. ..... 272/73
4,768,777 * 9/1988 Yang ..... 272/72
5,050,865 * 9/1991 Augspurger et al. ..... 272/73
5,114,391 * 5/1992 Pitzen et al. ..... 482/62
5,256,115 * 10/1993 Scholder et al. ..... 482/6
6,043,575 * 3/2000 Ghode et al. ..... 310/52

* cited by examiner

*Primary Examiner*—Elvin Enad

(57) ABSTRACT

A pedal operated power generating system for generating electricity. The pedal operated power generating system includes a generator adapted for coupling to an exercise device. The generator produces electricity when the exercise device rotates a drive wheel of the generator. A power housing is in electrical communication with the generator. The power housing has a plurality of electrical connectors adapted for coupling with external electrical devices.

7 Claims, 3 Drawing Sheets

14
24
25
15
24

23
12
22
13

PEDAL OPERATED POWER GENERATING SYSTEM

BACKGROUND OF THE INVENTION

1. Field of the Invention

The present invention relates to power generators and more particularly pertains to a new pedal operated power generating system for generating electricity.

2. Description of the Prior Art

The use of power generators is known in the prior art. More specifically, power generators heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,240,947; U.S. Pat. No. 4,612,447; U.S. Pat. No. 5,252,859; U.S. Pat. No. 4,389,047; U.S. Pat. No. 3,589,193; and U.S. Pat. No. Des. 320,826.

While these devices fulfill their respective, particular objectives and requirements, the aforementioned patents do not disclose a new pedal operated power generating system. The inventive device includes a generator adapted for coupling to an exercise device. The generator produces electricity when the exercise device rotates a drive wheel of the generator. A power housing is in electrical communication with the generator. The power housing has a plurality of electrical connectors adapted for coupling with external electrical devices.

In these respects, the pedal operated power generating system according to the present invention substantially departs from the conventional concepts and designs of the prior art, and in so doing provides an apparatus primarily developed for the purpose of generating electricity.

SUMMARY OF THE INVENTION

In view of the foregoing disadvantages inherent in the known types of power generators now present in the prior art, the present invention provides a new pedal operated power generating system construction wherein the same can be utilized for generating electricity.

The general purpose of the present invention, which will be described subsequently in greater detail, is to provide a new pedal operated power generating system apparatus and method which has many of the advantages of the power generators mentioned heretofore and many novel features that result in a new pedal operated power generating system which is not anticipated, rendered obvious, suggested, or even implied by any of the prior art power generators, either alone or in any combination thereof.

To attain this, the present invention generally comprises a generator adapted for coupling to an exercise device. The generator produces electricity when the exercise device rotates a drive wheel of the generator. A power housing is in electrical communication with the generator. The power housing has a plurality of electrical connectors adapted for coupling with external electrical devices.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new pedal operated power generating system apparatus and method which has many of the advantages of the power generators mentioned heretofore and many novel features that result in a new pedal operated power generating system which is not anticipated, rendered obvious, suggested, or even implied by any of the prior art power generators, either alone or in any combination thereof.

It is another object of the present invention to provide a new pedal operated power generating system which may be easily and efficiently manufactured and marketed.

It is a further object of the present invention to provide a new pedal operated power generating system which is of a durable and reliable construction.

An even further object of the present invention is to provide a new pedal operated power generating system which is susceptible of a low cost of manufacture with regard to both materials and labor, and which accordingly is then susceptible of low prices of sale to the consuming public, thereby making such pedal operated power generating system economically available to the buying public.

Still yet another object of the present invention is to provide a new pedal operated power generating system which provides in the apparatuses and methods of the prior art some of the advantages thereof, while simultaneously overcoming some of the disadvantages normally associated therewith.

Still another object of the present invention is to provide a new pedal operated power generating system for generating electricity.

Yet another object of the present invention is to provide a new pedal operated power generating system which includes a generator adapted for coupling to an exercise device. The generator produces electricity when the exercise device rotates a drive wheel of the generator. A power housing is in electrical communication with the generator. The power housing has a plurality of electrical connectors adapted for coupling with external electrical devices.

Still yet another object of the present invention is to provide a new pedal operated power generating system that reduces the power needs of a home or gym.

Even still another object of the present invention is to provide a new pedal operated power generating system that provides back up power in the event of a power outage.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
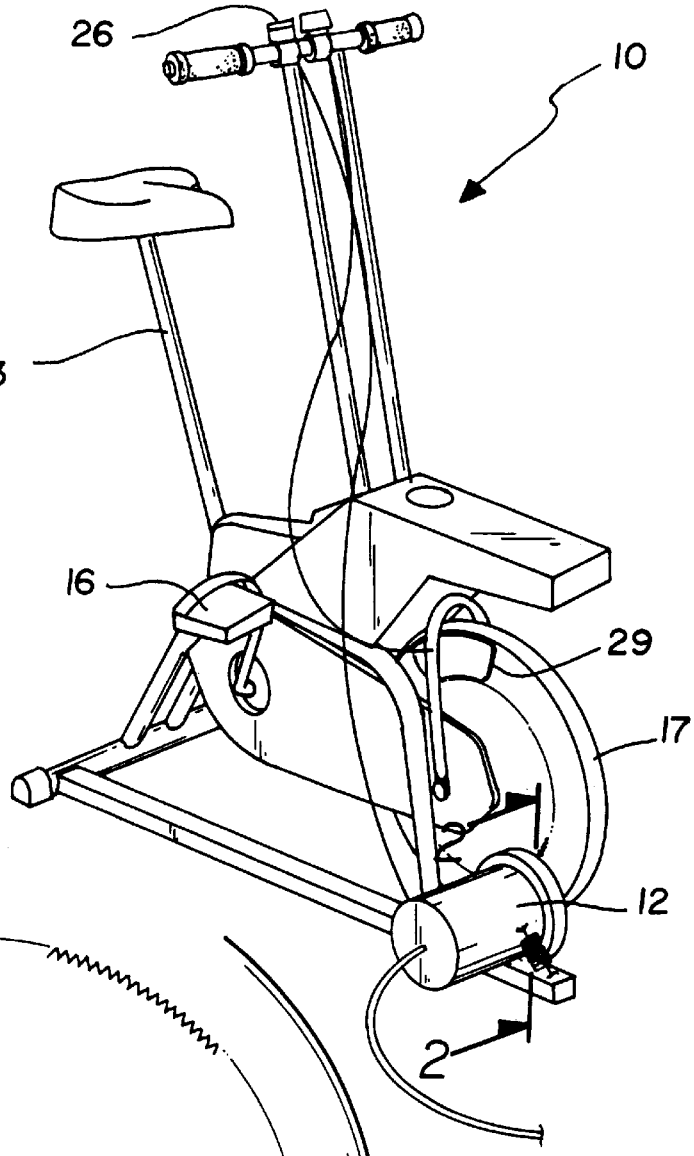
FIG. 1 is a schematic perspective view of a new pedal operated power generating system according to the present invention.
Figure 2:
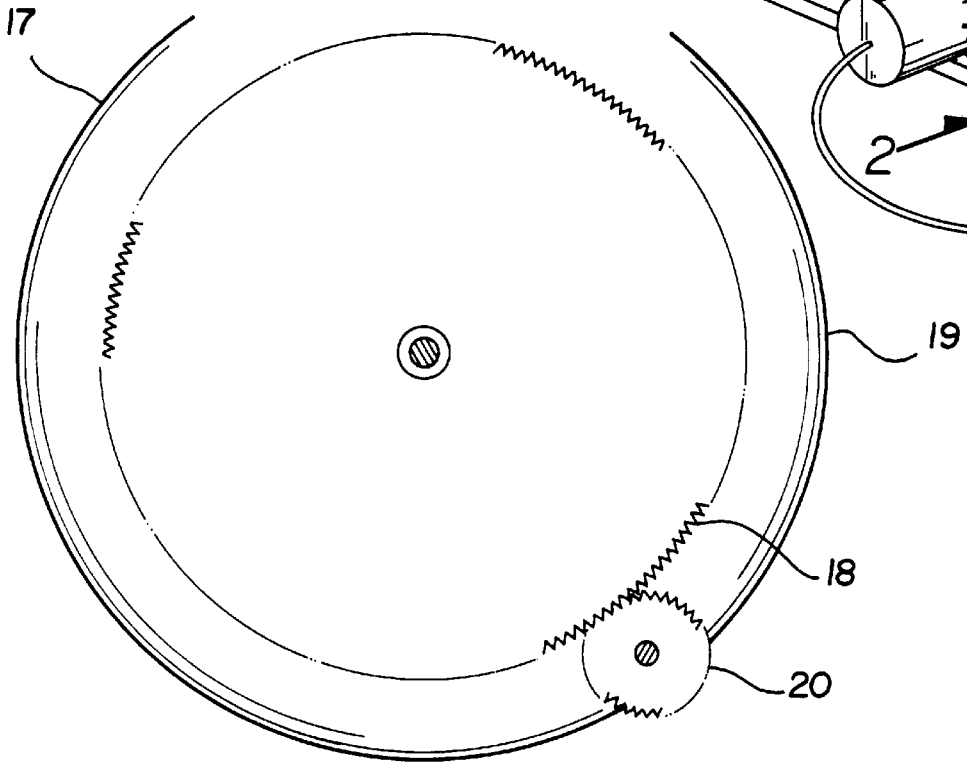
FIG. 2 is a schematic detailed view of the present invention taken from line 2—2 of FIG. 1.
Figure 3:
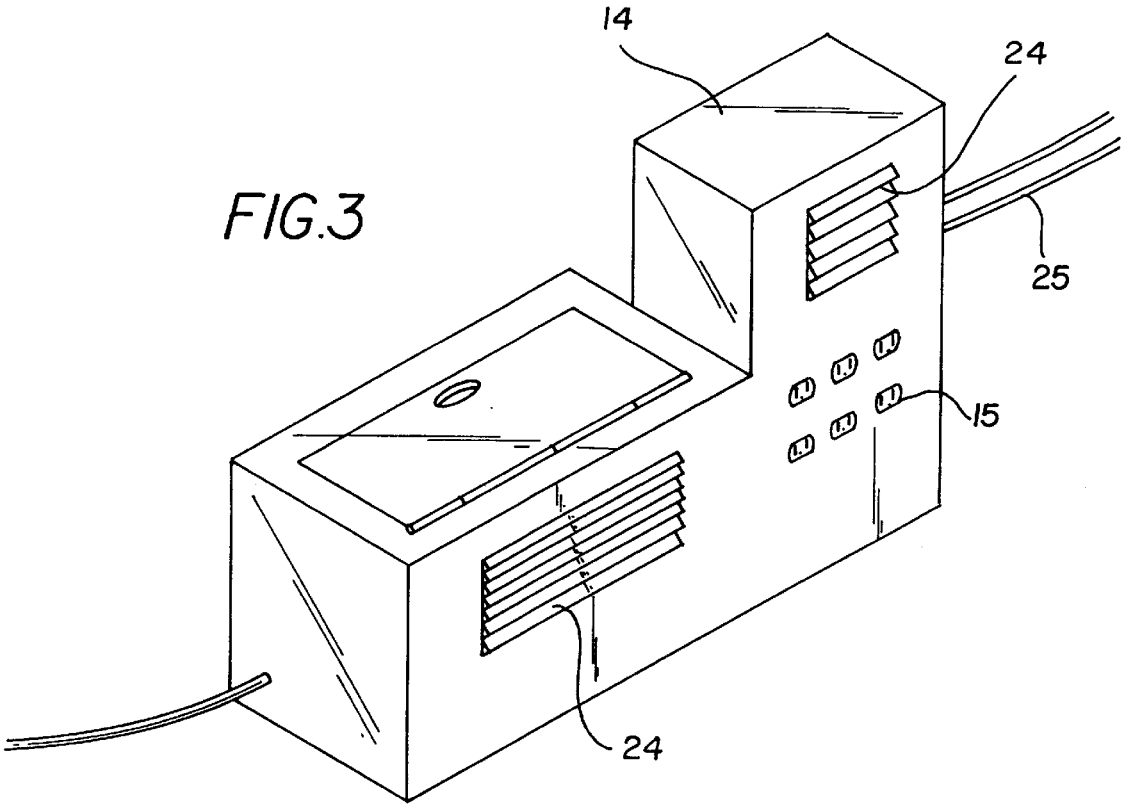
FIG. 3 is a schematic perspective view of the present invention.
Figure 4:
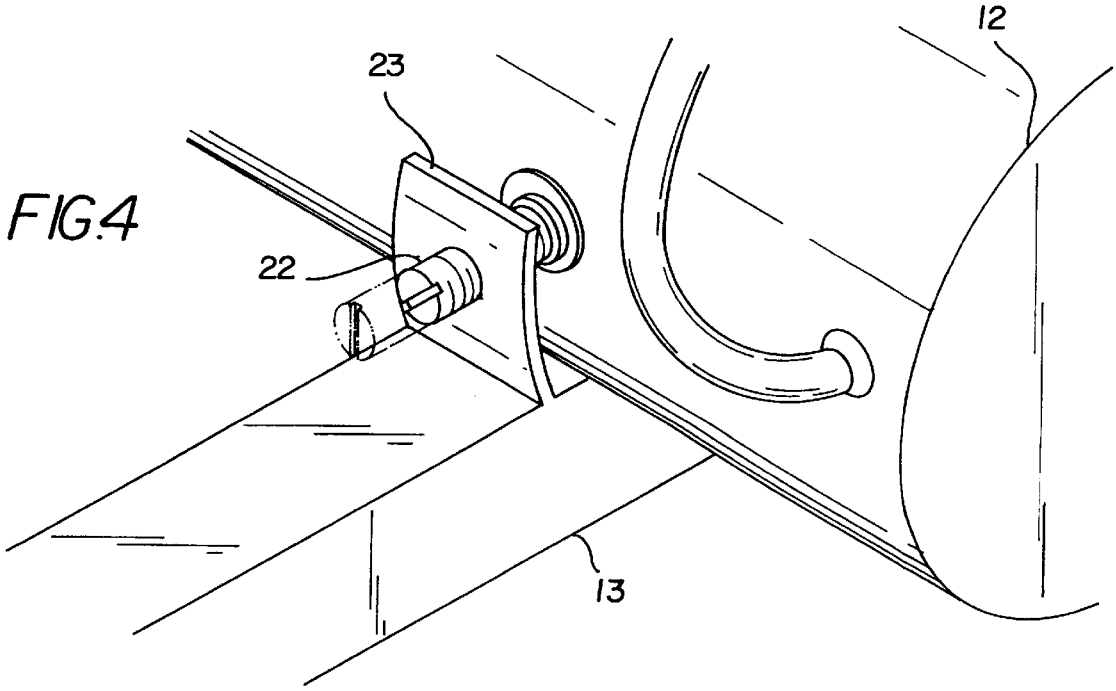
FIG. 4 is a schematic detailed view of the present invention.
Figure 5:
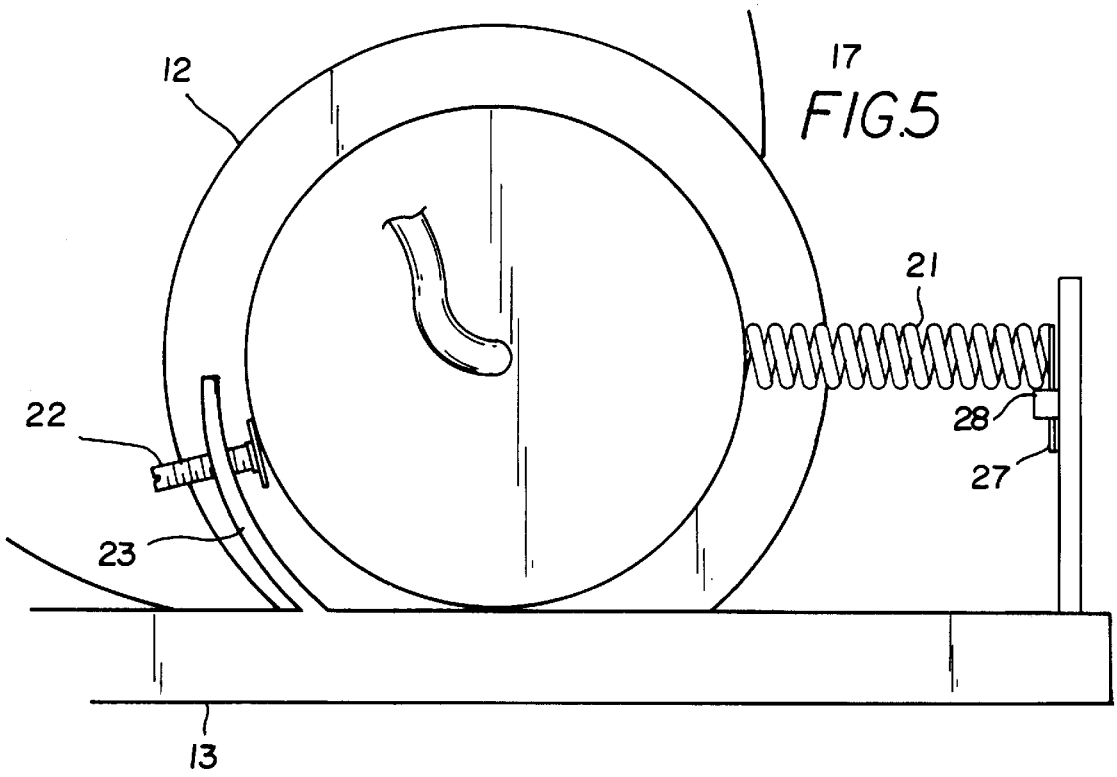
FIG. 5 is a schematic detailed view of the present invention.
Figure 6:
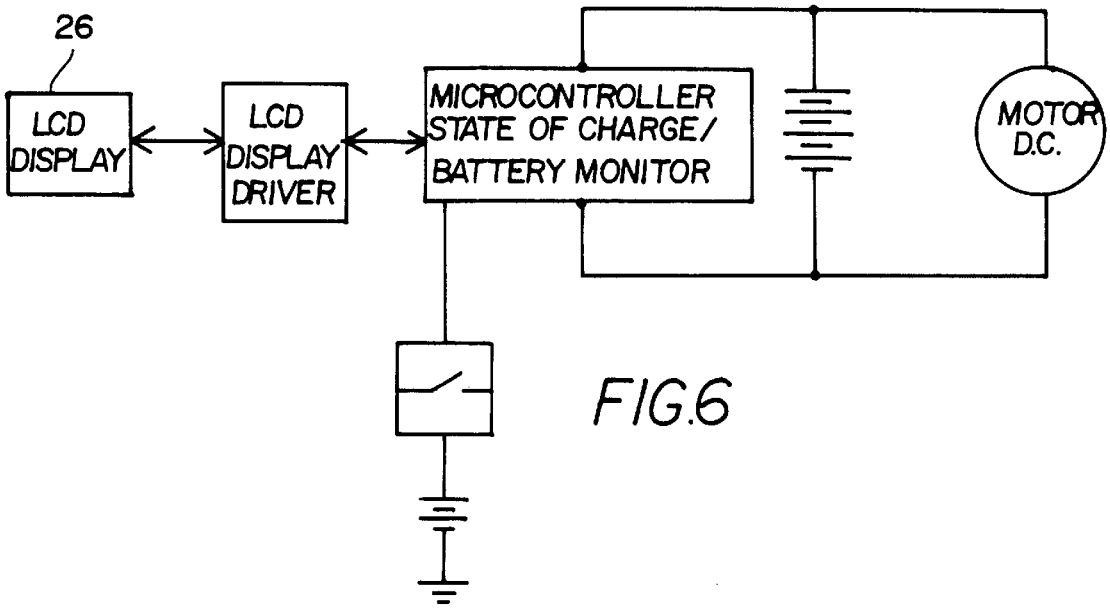
FIG. 6 is a schematic diagram of the present invention.

With reference now to the drawings, and in particular to FIGS. 1 through 6 thereof, a new pedal operated power generating system embodying the principles and concepts of the present invention and generally designated by the reference numeral 10 will be described.

As best illustrated in FIGS. 1 through 6, the pedal operated power generating system 10 generally comprises a generator 12 adapted for coupling to an exercise device 13. The generator produces electricity when the exercise device rotates a drive wheel of the generator. A power housing 14 is in electrical communication with the generator. The power housing has a plurality of electrical connectors 15 such as electrical sockets that are adapted for coupling with external electrical devices.

Preferably, the exercise machine has a pair of pedals 16 and a wheel 17 that is rotated when the pedals are rotated. A tensioning brake 29 may also be included to provide resistance to rotation of the wheel. The generator engages the wheel and produces electricity when the wheel rotates. Ideally, the wheel has a toothed ring 18 extending thereabout inside of an outer tire 19. The generator has a drive wheel 20 engaging the toothed ring. Alternatively, the drive wheel may be driven by a belt (not shown) that is rotated by the pedals.

Preferably, the generator is detachably coupled to the exercise machine. This permits use of the exercise device without producing electricity.

Also preferably, a spring 21 biases the generator towards the toothed ring. Ideally, the spring is positioned such that it biases the generator towards a corner formed between a base shaft of the exercise machine and the wheel to help keep the drive wheel engaged to the toothed wheel. The spring may be detachably coupled to the exercise machine by a tongue 27 insertable in a loop 28.

Ideally, a setscrew 22 threadably extends through a flange 23 of the exercise machine and is positioned on an opposite side of the generator as the spring for controlling the amount of biasing of the spring. The setscrew also may be used to disengage the drive wheel of the generator from the toothed ring of the wheel.

Preferably, the generator produces direct current electricity. Optionally, the power housing may have a power converter (not shown) for converting electricity from direct current to alternating current.

Also preferably, the power housing has a battery (not shown) removably disposed therein that is removable through an access panel in the power housing. An exemplary battery is a marine battery of the type used to power trawling motors.

Ideally, the power housing has a plurality of vent openings 24 for releasing warm air from the power housing. The cooling provided by the vents prolongs the life of the battery.

Optionally, the power housing may have a power cord 25 adapted for coupling to an exterior power source as well as for providing power to a wiring system of a structure. This permits the power housing to have a constant source of power for charging the battery as well as permitting use of electrical devices connected to the electrical connections of the battery housing.

Also optionally, a monitoring gauge 26 may be electrically connected to the generator for providing a visual display of the amount of power produced by the generator.

In use, the generator is coupled to the exercise device. The pedals are pedaled to rotate the drive wheel of the generator, thereby producing energy, which is stored in the battery and/or used to power electronic devices.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A power generating system adapted for coupling to an exercise machine, the system comprising:

a drive member mountable on a wheel of an exercise device in a manner causing rotation of said drive member with the wheel, said drive member having a plurality of teeth formed on a perimeter of said drive member;

a generator for coupling to an exercise device, said generator producing electricity when said exercise device rotates a drive wheel of said generator, said drive wheel having a plurality of teeth for engaging said teeth of said perimeter of said drive member for minimizing slippage between said drive wheel and said drive member;

a power housing in electrical communication with said generator, said power housing having a plurality of electrical connectors such that said power housing is adapted for coupling with external electrical devices; and a spring biasing said generator towards said toothed ring;

wherein each of said electrical connectors comprises an electrical outlet.

2. The system of claim 1, further comprising a setscrew for controlling the amount of biasing of said spring.

3. The system of claim 1, wherein said generator produces direct current electricity, said power housing having a power converter for converting electricity from direct current to alternating current.

4. The system of claim 1, wherein said power housing has a battery therein.

5. The system of claim 1, wherein said power housing has a plurality of vent openings for releasing warm air from said power housing.

6. The system of claim 1, wherein said power housing has a power cord for coupling to an exterior power source.

7. A power generating system, comprising:

a pedal exercise machine having a pair of pedals and a wheel;

a generator engaging said wheel, said generator producing electricity when said wheel rotates;

wherein said wheel has a toothed ring extending therearound, said generator having a drive wheel engaging said toothed ring;

said generator being detachably coupled to said exercise machine;

said generator producing direct current electricity;

a spring biasing said generator towards said toothed ring, said spring being positioned such that said spring biases said generator towards a corner formed between a base shaft of said exercise machine to facilitate said wheel keeping and said wheel for helping said drive wheel engaged to said toothed wheel;

a setscrew extending through a flange of said exercise machine and positioned on an opposite side of said generator as said spring for controlling the amount of biasing of said spring;

a power housing in electrical communication with said generator;

said power housing having a plurality of electrical connectors such that said power housing is adapted for coupling with external electrical devices;

said power housing having a power converter for converting electricity from direct current to alternating current;

said power housing having a battery therein such that said battery stores electricity produced by said generator;

said power housing having a plurality of vent openings for releasing warm air from said power housing;

said power housing having a power cord such that said power housing is adapted for coupling to an exterior power source; and wherein each of said electrical connectors comprises an electrical outlet.

* * * * *